US006536459B2

(12) United States Patent
Huang

(10) Patent No.: US 6,536,459 B2
(45) Date of Patent: Mar. 25, 2003

(54) CONTROL VALVE STRUCTURE OF A GAS BURNER

(76) Inventor: Chung-Chin Huang, 58, Ma Yuan West St., Taichung (TW)

( * ) Notice: Subject to any disclaimer, the term of this patent is extended or adjusted under 35 U.S.C. 154(b) by 24 days.

(21) Appl. No.: 09/834,542

(22) Filed: Apr. 15, 2001

(65) Prior Publication Data

US 2002/0148500 A1 Oct. 17, 2002

(51) Int. Cl.[7] ..... G05D 7/06
(52) U.S. Cl. ..... 137/66; 431/59
(58) Field of Search ..... 137/66, 65, 613; 431/80, 53, 54, 59

(56) References Cited

U.S. PATENT DOCUMENTS 3,711,236 A * 1/1973 Kinsella et al. ..... 431/80 X
4,044,794 A * 8/1977 Matthews ..... 137/66 X
4,413,975 A * 11/1983 Turner et al. ..... 431/53 X
6,263,908 B1 * 7/2001 Love et al. ..... 137/66 X

* cited by examiner

*Primary Examiner*—Kevin Lee

(57) ABSTRACT

A control valve structure of a gas burner includes a female base, a top base, and a coil base. The control panel energizes the coil base to generate a magnetic field, whereby the magnetic column is displaced upward by the magnetic force of the coil base, so that the main fire electromagnetic valve is acted to let the gas flow into a main fire gas vent, so that the main fire is ignited. The control panel stops energizing the coil base when not in use, whereby the magnetic column is displaced downward to press the push pin, so that the gas cannot enter the main fire gas vent. The displacement can be adjusted finely during the use process, thereby achieving a gas flow rate control with a high safety.

2 Claims, 8 Drawing Sheets

CONTROL VALVE STRUCTURE OF A GAS BURNER

BACKGROUND OF THE INVENTION

1. Field of the Invention

The present invention relates to a proportion type control valve structure of a gas burner.

2. Description of the Related Art

A conventional gas burner may ignite the main fire by the female fire, and comprises a coil base, a hollow fixing rod fitted in the coil base, and an iron column mounted in the fixing rod. When the coil base is energized, it will produce a magnetic field, so that the iron column may be moved downward to press the push pin. However, the press force of the iron column is set to be a constant and cannot be controlled precisely. Thus, the iron column may have a larger displacement, so that when the gas of the main fire is driven by the water pressure, the burning action has to be processed at a greater water pressure. If the water pressure is not large enough to drive the main fire electromagnetic valve to operate, there will be no hot water to be used.

SUMMARY OF THE INVENTION

The primary objective of the present invention is to provide a proportion type control valve structure of a gas burner, wherein the magnetic column may be displaced upward and downward by the magnetic field of the coil base, thereby adjusting the current of the coil base, so that the amount of displacement can be controlled accurately, so as to control the gas flow rate precisely.

Another objective of the present invention is to provide a proportion type control valve structure of a gas burner, wherein the current supplied to the coil base can be efficiently adjusted by the control panel, so that the amount of displacement of the magnetic column can be controlled accurately, so as to control the gas flow rate precisely.

A further objective of the present invention is to provide a proportion type control valve structure of a gas burner, wherein the gas flow rate of the main fire can be controlled precisely, thereby obtaining a more stable heat output.

In accordance with the present invention, there is provided a proportion type control valve structure of a gas burner, comprising: a female base, a top base, and a coil base, the female base having an inner portion including three gas storage chambers, and an outer portion having a first side provided with a main fire gas vent and a female fire gas vent, and a second side provided with a gas inlet, the first gas storage chamber communicating with the gas inlet, the inner portion of the female base defining a channel so that the second gas storage chamber communicates with the female fire gas vent, a lower gas pressure valve set mounted on a bottom of the female base, a protective board used for sealing the lower gas pressure valve set on the bottom of the female base, an upper gas pressure valve set mounted on a top of the female base, and the top base used for sealing the top gas pressure valve set on the top of the female base, the top base 20 having a top provided with a main fire electromagnetic valve and a female fire electromagnetic valve, the main fire electromagnetic valve having a top provided with two abutting positioning plates, a push pin pivoted on a top of the positioning plates, a fixing base used for sealing the push pin and the positioning plates on the top of the top base, the coil base pivoted on a center of the fixing base and connected to a control panel, a fixing rod passing through the coil base, and having a front end screwed in the fixing base, the fixing rod being a hollow rod having an inner thread;

wherein, a magnetic column is received in the fixing rod, a positioning piece is screwed on a top of the fixing rod, the control panel is used to control the action of the coil base;

the control panel energizes the coil base to generate a magnetic field, whereby the magnetic column is displaced upward by the magnetic force of the coil base, so that the main fire electromagnetic valve is acted to let the gas flow into a main fire gas vent, so that the main fire is ignited;

the control panel stops energizing the coil base when not in use, whereby the magnetic column is displaced downward to press the push pin, so that the gas cannot enter the main fire gas vent;

the displacement can be adjusted finely during the use process, thereby achieving a gas flow rate control with a high safety.

Further benefits and advantages of the present invention will become apparent after a careful reading of the detailed description with appropriate reference to the accompanying drawings.

DETAILED DESCRIPTION OF THE INVENTION

Figure 1:
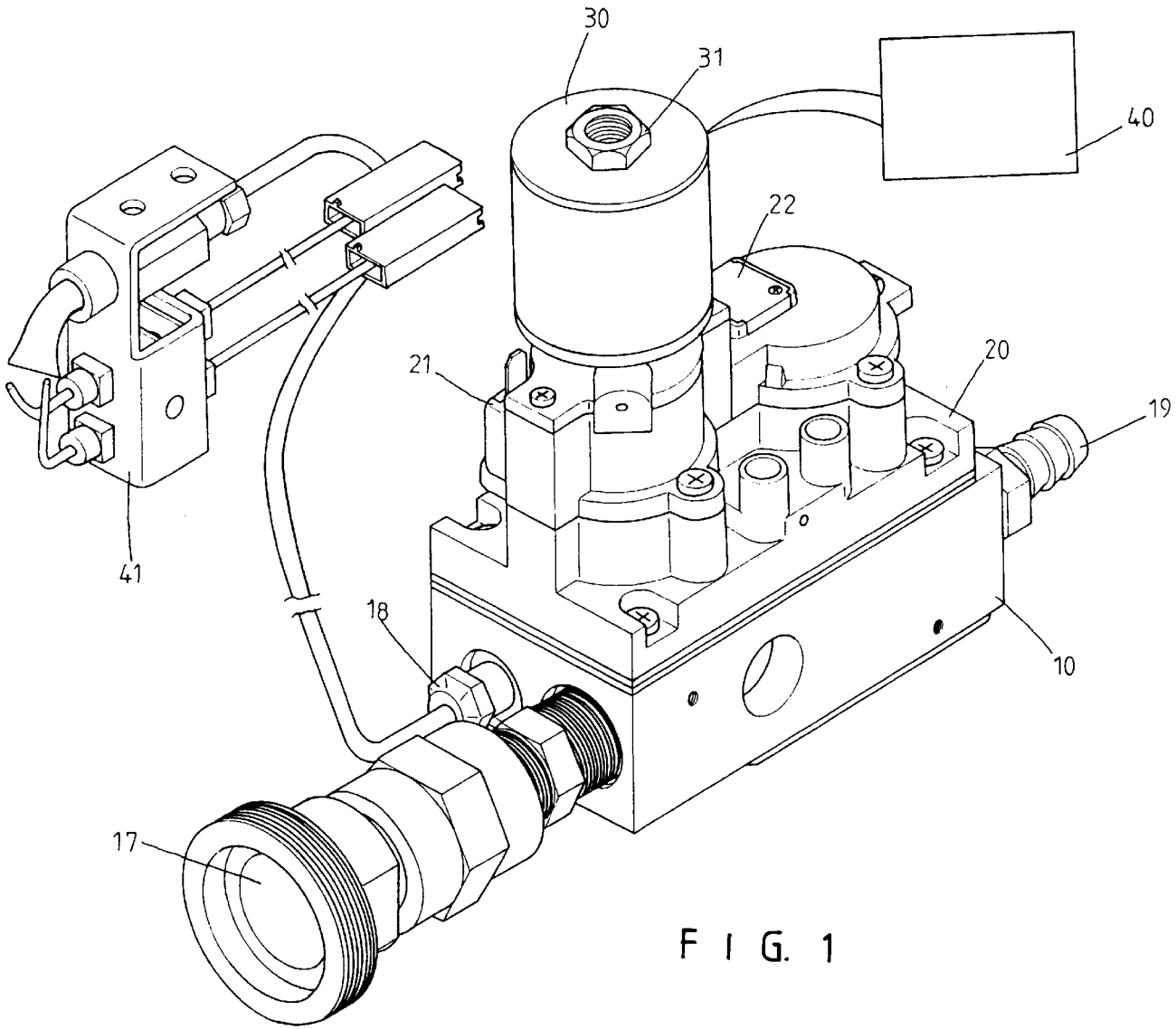
FIG. 1 is a perspective view of a proportion type control valve structure of a gas burner in accordance with a first embodiment of the present invention.
Figure 2:
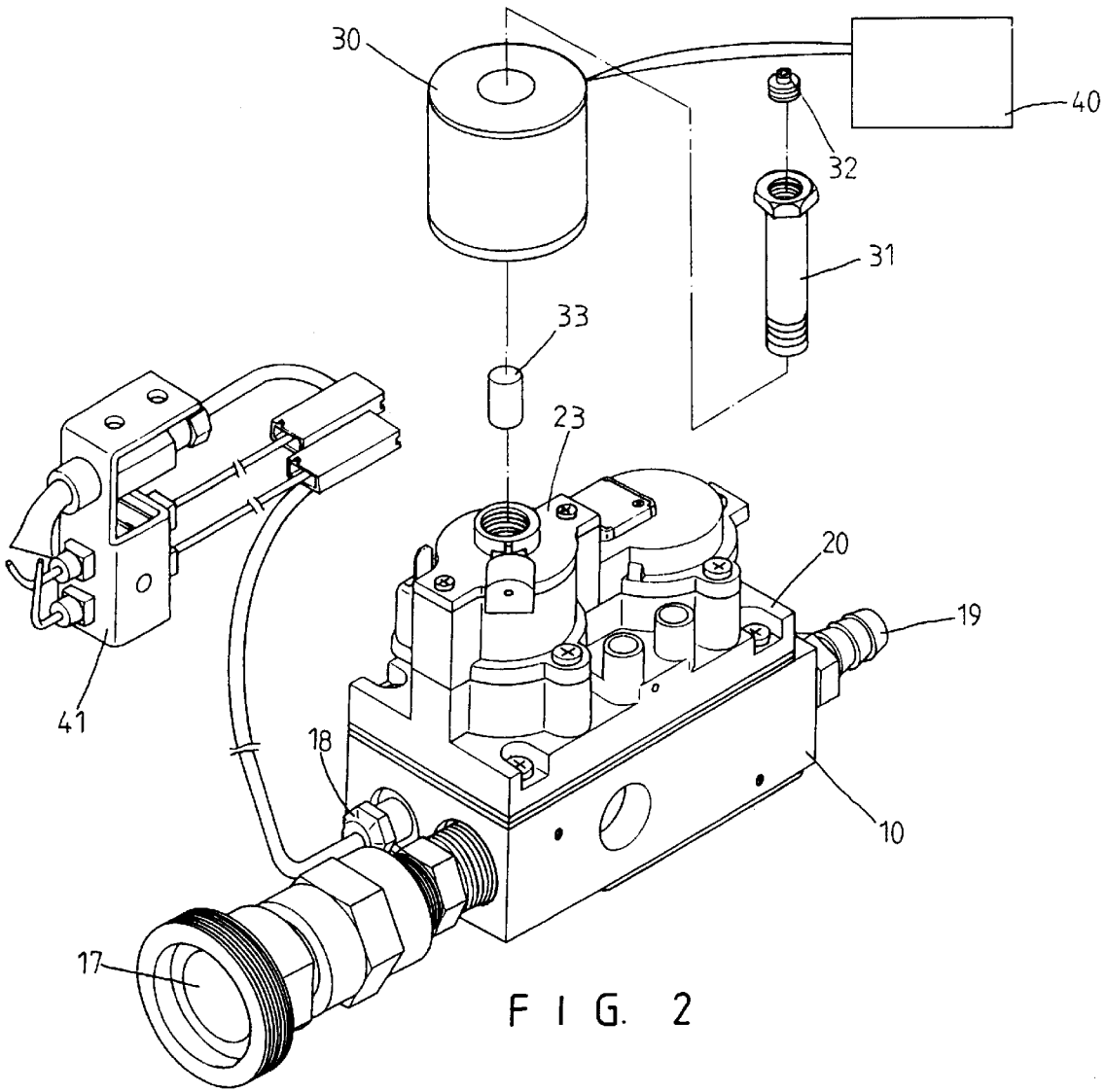
FIG. 2 is a partially exploded view of the proportion type control valve structure of a gas burner as shown in FIG. 1.
Figure 3:
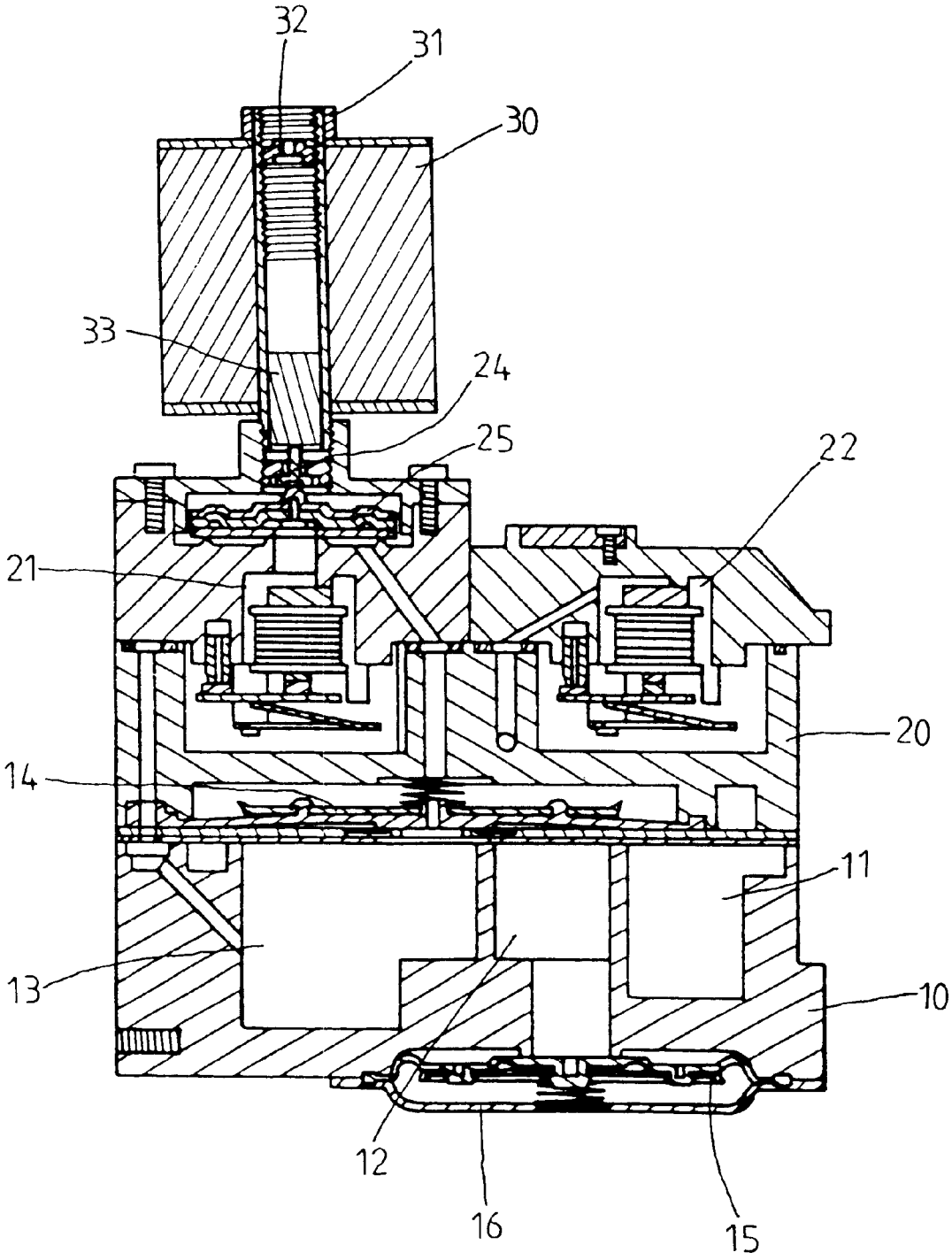
FIG. 3 is a front plan cross-sectional view of the proportion type control valve structure of a gas burner as shown in FIG. 1.
Figure 4:
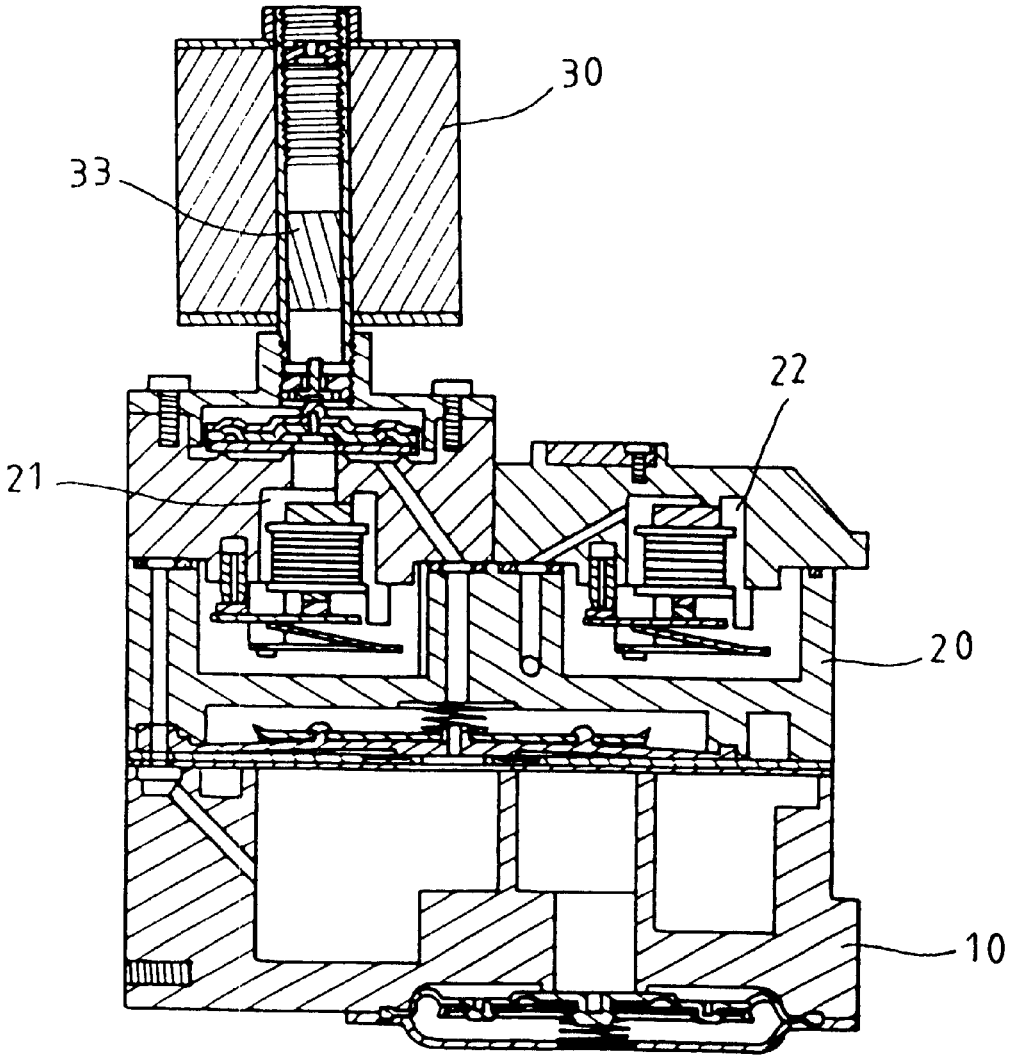
FIG. 4 is a schematic operational view of the proportion type control valve structure of a gas burner as shown in FIG. 3.

Referring to the drawings and initially to FIGS. 1–4, a proportion type control valve structure of a gas burner in accordance with the present invention comprises a female base 10, a top base 20, and a coil base 30. The female base 10 has an inner portion including three gas storage chambers, and an outer portion having a first side provided with a main fire gas vent 17 and a female fire gas vent 18, and a second side provided with a gas inlet 19. The first gas storage chamber 11 communicates with the gas inlet 19. The inner portion of the female base 10 defines a channel so that the second gas storage chamber 12 communicates with the female fire gas vent 18. A lower gas pressure valve set 15 is mounted on the bottom of the female base 10, and a protective board 16 is used for sealing the lower gas pressure valve set 15 on the bottom of the female base 10. An upper gas pressure valve set 14 is mounted on the top of the female base 10, and the top base 20 is used for sealing the top gas pressure valve set 14 on the top of the female base 10. The top of the top base 20 is respectively provided with a main fire electromagnetic valve 21 and a female fire electromagnetic valve 22. The top of the main fire electromagnetic valve 21 is provided with two abutting positioning plates 25. A push pin 24 is pivoted on the top of the positioning plates 25. A fixing base 23 is used for sealing the push pin 24 and the positioning plates 25 on the top of the top base 20. The coil base 30 is pivoted on the center of the fixing base 23. A fixing rod 31 is passed through the coil base 30, and has a front end screwed in the fixing base 23. The fixing rod 31 is a hollow rod having an inner thread. A magnetic column 33 is received in the fixing rod 31. A positioning piece 32 is screwed on the top of the fixing rod 31. A control panel 40 is used to control the action of the coil base 30.

Thus, when the gas enters the first gas storage chamber 11 of the female base 10 through the gas inlet 19, the female fire electromagnetic valve 22 is acted, so that the gas in the first gas storage chamber 11 flows into the second gas storage chamber 12, and flows to the female fire gas vent 18, so that the female igniter 41 may ignite the female fire. Then, the control panel 40 energizes the coil base 30 to generate a magnetic field, whereby the magnetic column 33 is displaced upward by the magnetic force of the coil base 30, so that the main fire electromagnetic valve 21 is acted to let the gas flow into the third gas storage chamber 13, so that the main fire is ignited through the main fire gas vent 17. Then, the control panel 40 stops energizing the coil base 30, whereby the magnetic column 33 is displaced downward to press the push pin 24, so that the gas cannot enter the main fire gas vent 17. The displacement can be adjusted finely during the use process, thereby achieving a gas flow rate control with a high safety.

Figure 5:
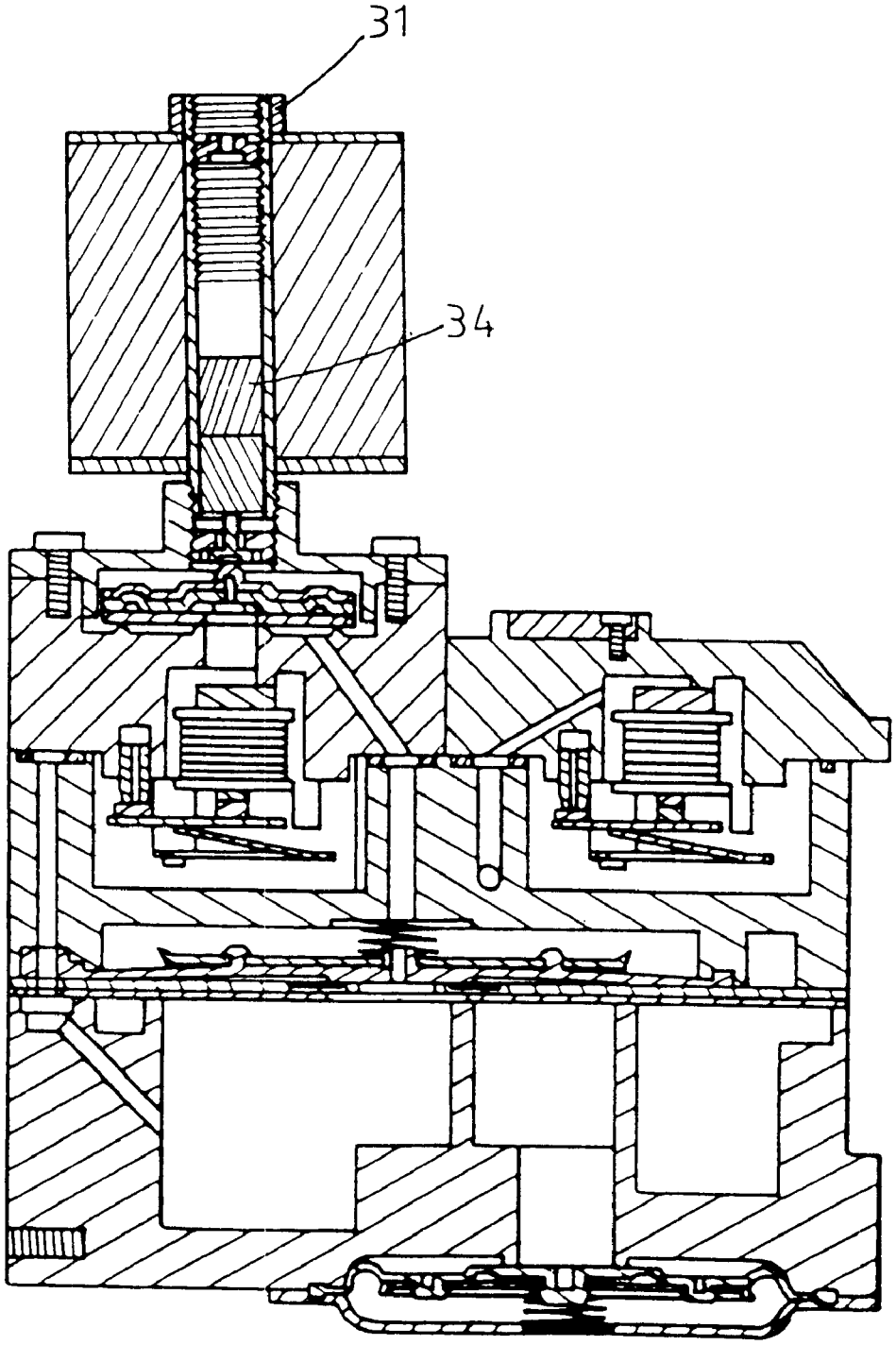
FIG. 5 is a front plan cross-sectional assembly view of a proportion type control valve structure of a gas burner in accordance with a second embodiment of the present invention.
Figure 5A:
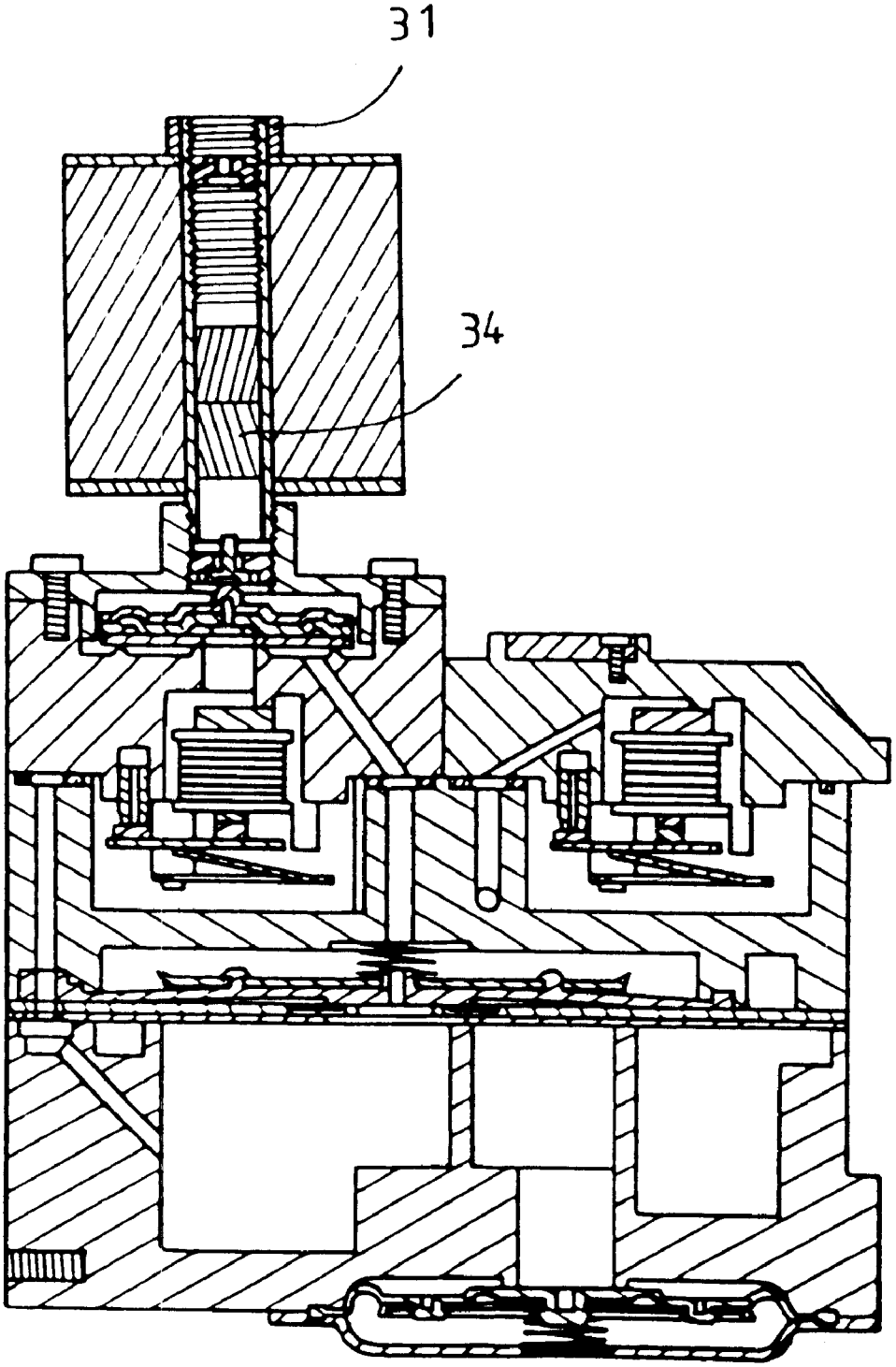
FIG. 5A is a schematic operational view of the proportion type control valve structure of a gas burner as shown in FIG. 5.
Figure 6:
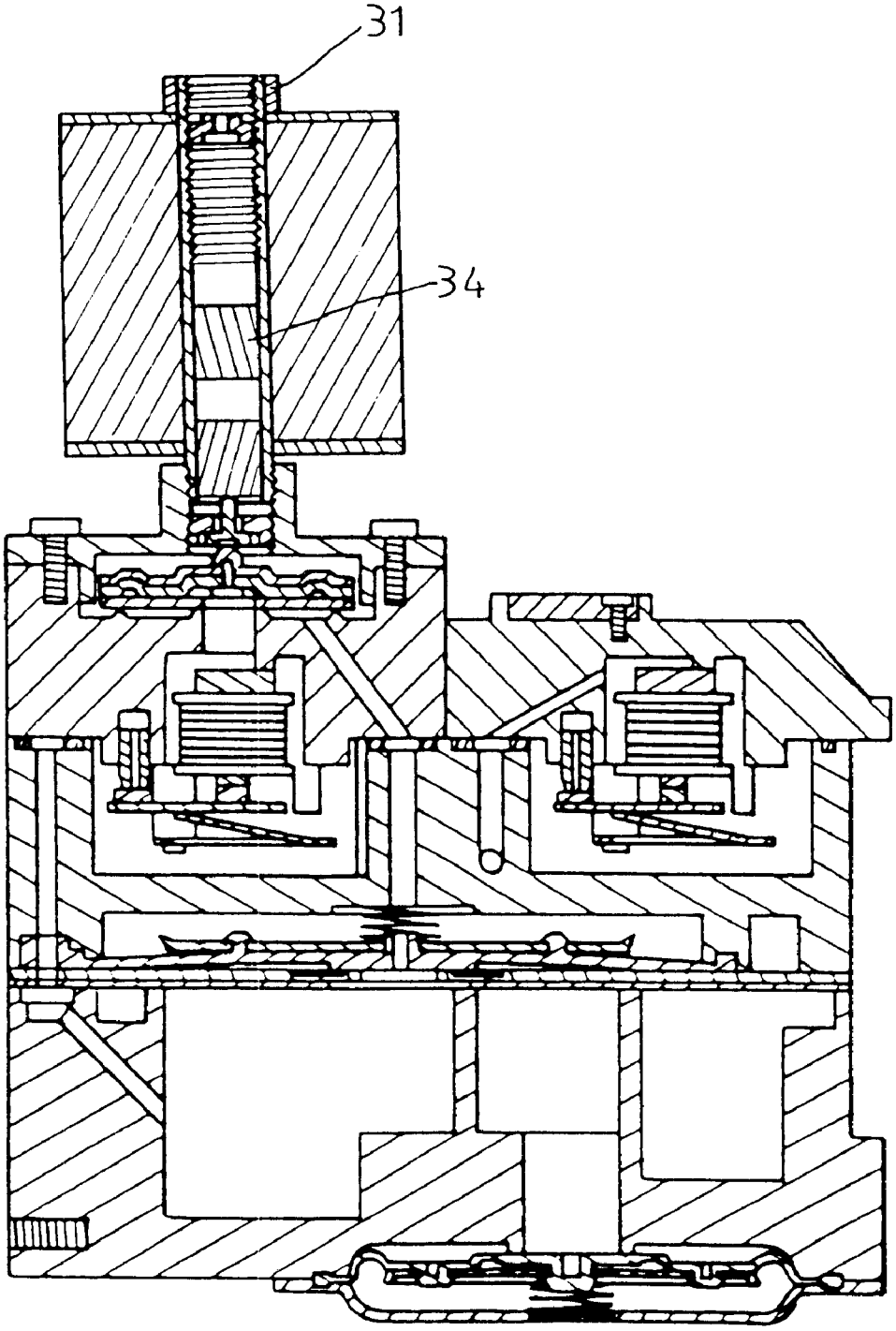
FIG. 6 is a front plan cross-sectional assembly view of a proportion type control valve structure of a gas burner in accordance with the second embodiment of the present invention.
Figure 6A:
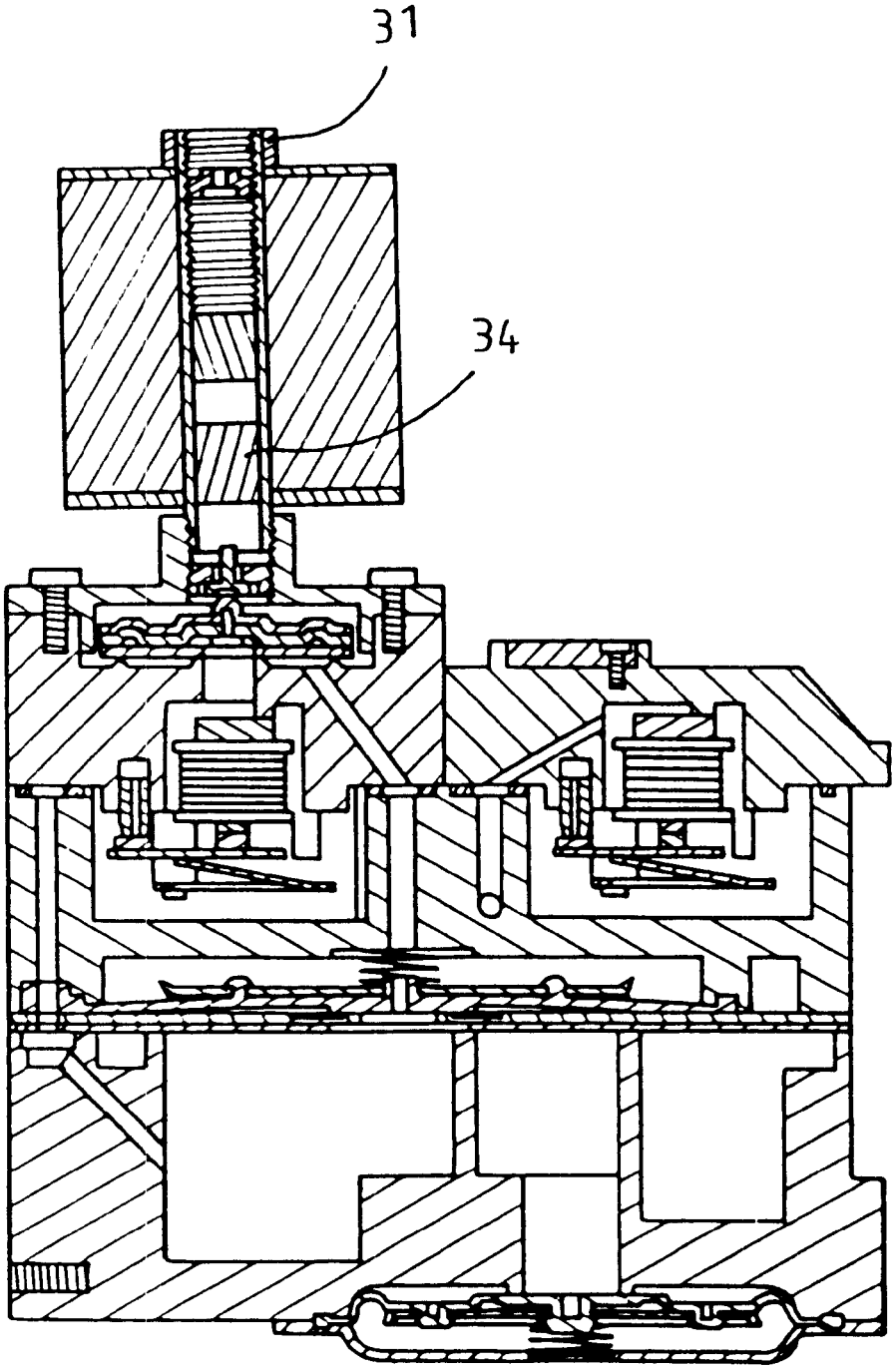
FIG. 6A is a schematic operational view of the proportion type control valve structure of a gas burner as shown in FIG. 6.

Referring to FIGS. 5, 5A, 6 and 6A, the fixing rod 31 contains two magnetic blocks 34 therein. The displacement distance of the two magnetic blocks 34 can be controlled precisely by the attractive or repellent action of the two magnetic blocks 34, so that the gas flow rate can be controlled precisely.

Although the invention has been explained in relation to its preferred embodiment as mentioned above, it is to be understood that many other possible modifications and variations can be made without departing from the scope of the present invention.

What is claimed is:

1. A proportion type control valve structure of a gas burner, comprising: a female base, a top base, and a coil base, the female base having an inner portion including three gas storage chambers, and an outer portion having a first side provided with a main fire gas vent and a female fire gas vent, and a second side provided with a gas inlet, the first gas storage chamber communicating with the gas inlet, the inner portion of the female base defining a channel so that the second gas storage chamber communicates with the female fire gas vent, a lower gas pressure valve set being mounted on a bottom of the female base, a protective board being mounted on the bottom of the female base and enclosed around the lower gas pressure valve set to seal the lower gas pressure valve set on the bottom of the female base, an upper gas pressure valve set being mounted on a top of the female base, the top base being mounted on the top of the female base and enclosed around the top gas pressure valve set to seal the top gas pressure valve set on the top of the female base, the top base having a top respectively provided with a main fire electromagnetic valve and a female fire electromagnetic valve, the main fire electromagnetic valve having a top provided with two abutting positioning plates, a push pin being mounted on a top of the positioning plates, a fixing base being mounted on the top of the top base and enclosed around the push pin and the positioning plates to seal the push pin and the positioning plates on the top of the top base, the coil base being mounted on a center of the fixing base and connected to a control panel, a fixing rod passing through the coil base, and having a front end screwed in the fixing base, the fixing rod being a hollow rod having an inner thread;

wherein, a magnetic column is received in the fixing rod, a positioning piece is screwed on a top of the fixing rod, the control panel is used to control action of the coil base;

the control panel energizes the coil base to generate a magnetic field, whereby the magnetic column is displaced upward by the magnetic force of the coil base, so that the main fire electromagnetic valve is acted to let the gas flow into the main fire gas vent, so that a main fire is ignited;

the control panel stops energizing the coil base when not in use, whereby the magnetic column is displaced downward to press the push pin, so that the gas cannot enter the main fire gas vent.

2. The proportion type control valve structure of a gas burner in accordance with claim 1, wherein the fixing rod contains two magnetic blocks therein, a displacement distance of the two magnetic blocks can be controlled by interaction of the two magnetic blocks.

* * * * *